US005910044A

United States Patent [19]

Luciano, Jr. et al.

[11] Patent Number: 5,910,044

[45] Date of Patent: Jun. 8, 1999

[54] COIN SEPARATOR AND TRANSPORT

[75] Inventors: Robert A. Luciano, Jr.; Logan L. Pease, both of Reno, Nev.; Robert A. Luciano, Sr., Lebanon, N.J.; Boone McReynolds, Reno, Nev.

[73] Assignee: International Game Technology, Reno, Nev.

[21] Appl. No.: 08/720,590

[22] Filed: Sep. 30, 1996

[51] Int. Cl.[6] ..... G07D 1/00

[52] U.S. Cl. ..... 453/32; 453/56

[58] Field of Search ..... 194/203, 317, 194/318, 328, 329, 330, 343, 346; 453/4, 7, 11, 32, 40, 49, 56, 57; 221/75

[56] References Cited

U.S. PATENT DOCUMENTS

| | | | |
|---|---|---|---|
| 3,197,006 | 7/1965 | Rub et al. | 194/242 |
| 4,457,320 | 7/1984 | Diamond | 194/317 |
| 4,558,711 | 12/1985 | Yoshiaki et al. | 453/3 |
| 4,574,824 | 3/1986 | Paulsen et al. . | |
| 4,650,057 | 3/1987 | Koester | 194/346 |
| 4,902,263 | 2/1990 | Ito et al. | 453/49 |
| 5,355,988 | 10/1994 | Shirasawa | 194/343 X |
| 5,496,211 | 3/1996 | Zimmermann | 453/3 |

FOREIGN PATENT DOCUMENTS

| | | | |
|---|---|---|---|
| 48825/85 | 5/1986 | Australia | G07F 17/34 |
| 22006/92 | 3/1994 | Australia | G07D 1/00 |
| 0 747 866 | 12/1996 | European Pat. Off. | G07D 9/00 |
| 3-126194 | 5/1991 | Japan | 453/56 |
| 1741 | of 1905 | United Kingdom | 194/343 |

*Primary Examiner*—F. J. Bartuska
*Attorney, Agent, or Firm*—Sheridan Ross P.C.

[57] ABSTRACT

An apparatus and method which reduces variation in coin position or velocity as coins are conveyed past an acceptance device is provided. In one embodiment coins are separated prior to conveyance past sensors. In one embodiment separation is achieved by stopping or pinching the following coin until a preceding coin has moved a predetermined distance. In one embodiment separation is achieved by engagement of sequential coins with different turns of a lead screw thread. In one embodiment separation is achieved by engagement of successive coins with rollers rotating at different velocities. Preferably, one or more belts are used to convey coins past an acceptance device at a known or constant velocity.

36 Claims, 3 Drawing Sheets

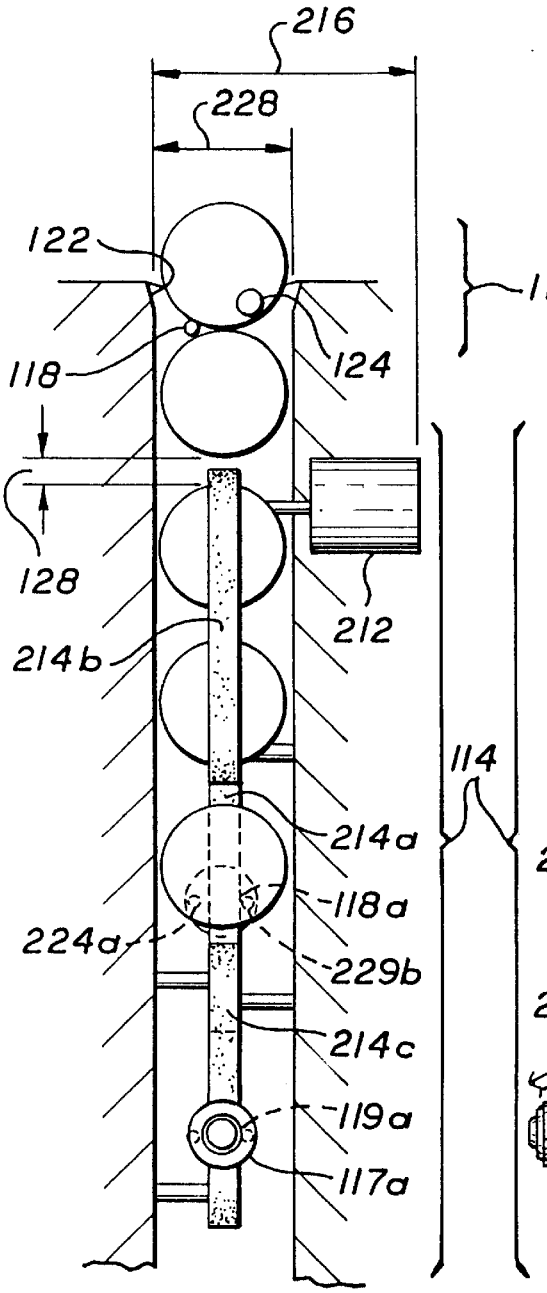
FIG.1
FIG.2
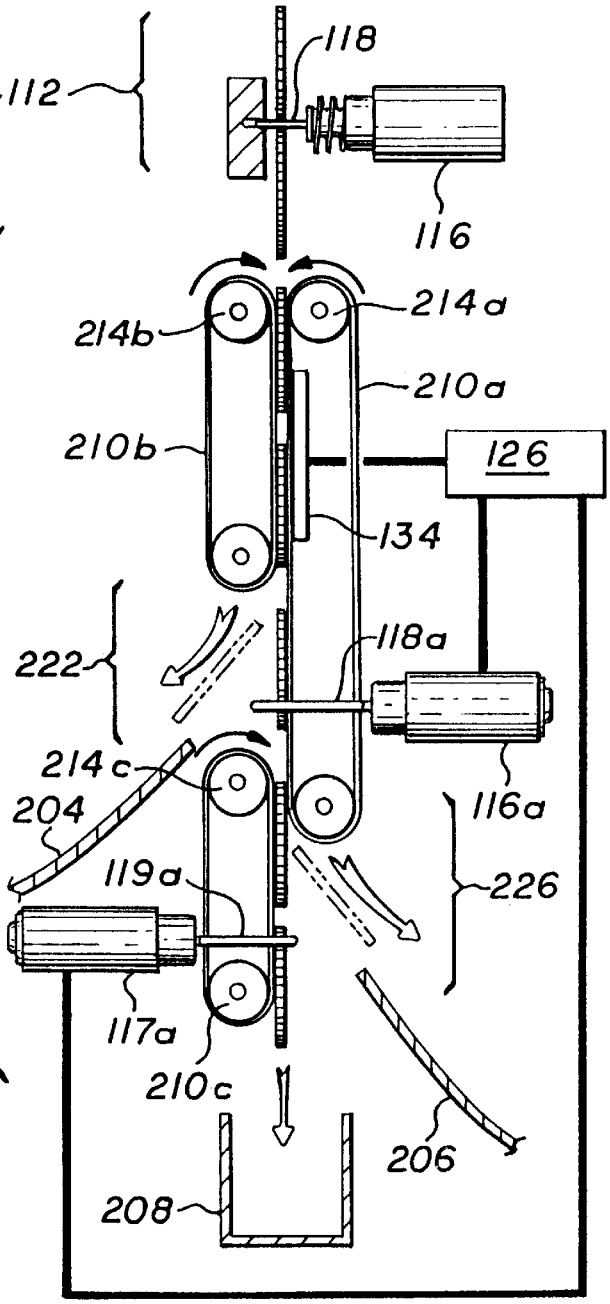

FIG.3A
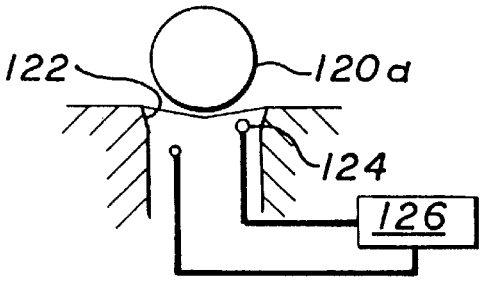
FIG.3B
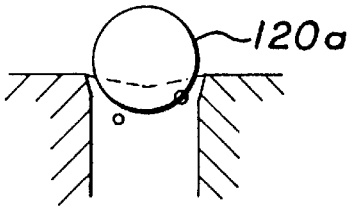
FIG.3C
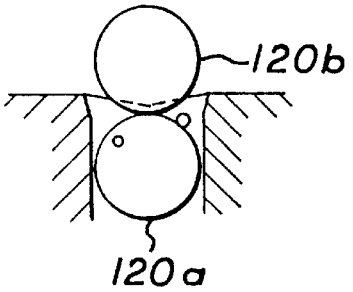
FIG.3D
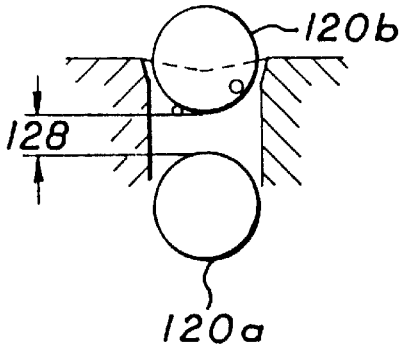
FIG.4
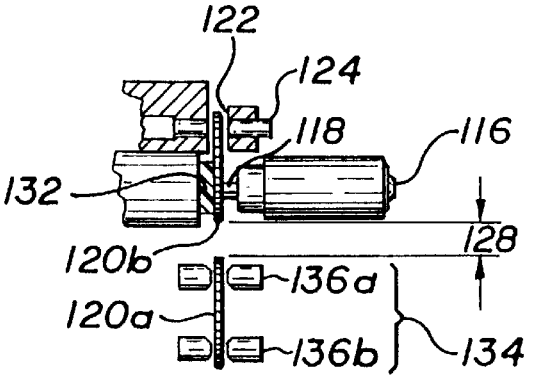
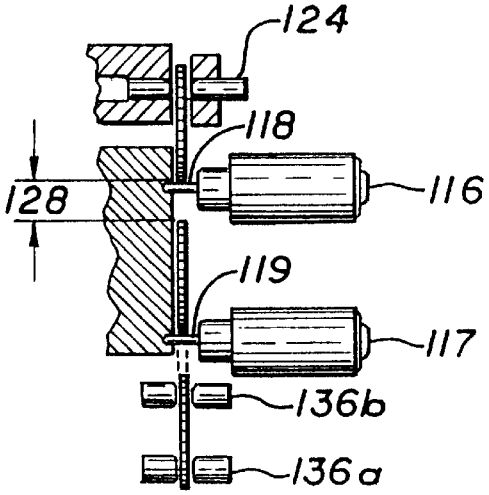
FIG.5

FIG.6
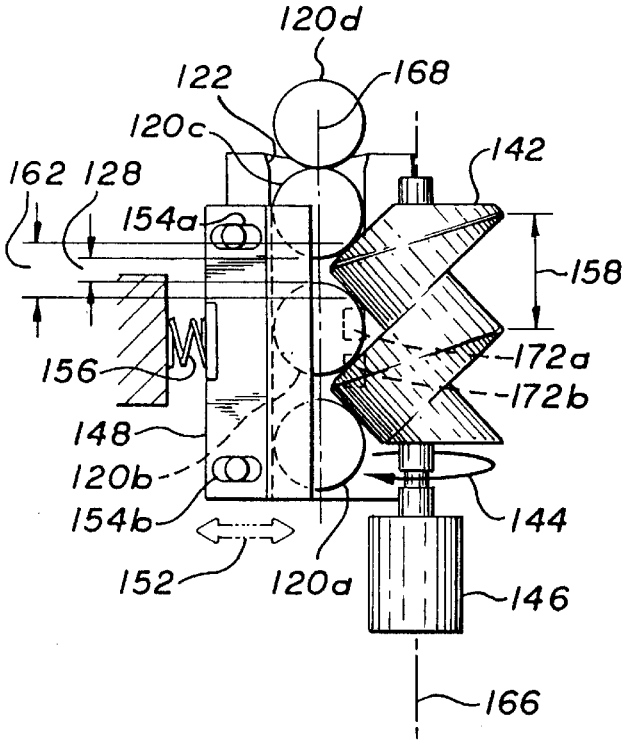
FIG.8A
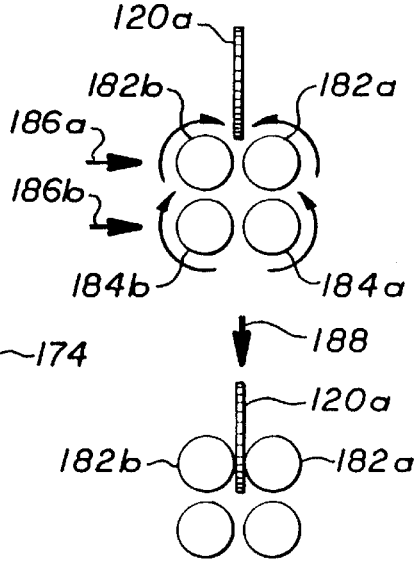
FIG.8B
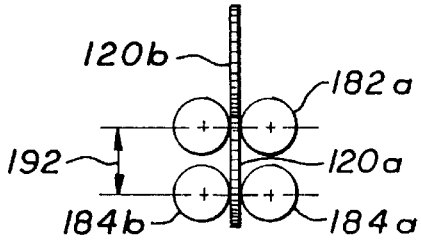
FIG.8C
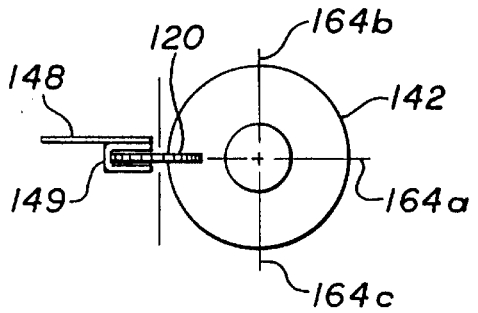
FIG.7
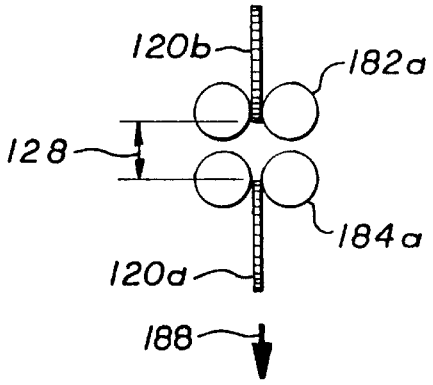
FIG.8D

COIN SEPARATOR AND TRANSPORT

The present invention relates to an apparatus and method for separating and transporting coins and particularly for providing a minimum separation and/or a substantially constant transport velocity for coin acceptor/counter devices in vending machines, gaming devices, pay telephones, fare boxes and the like.

BACKGROUND INFORMATION

A number of mechanisms are configured to accept and validate or count coins, including such devices as vending machines, certain gaming devices (slot machines), pay telephones, bus or subway fare boxes and the like. Miscounts or other malfunctions of such devices can result from a number of causes. Moreover, these devices may be susceptible to certain types of misuse or cheating, such as use of slugs or foreign coins, retrieval of coins following deposit and the like.

Accordingly, it would be useful to provide a coin handling device which provides a lower error rate (or permits use of less expensive acceptance/counting mechanisms without degrading performance) and is less susceptible to misuse or cheating. Preferably, the device is relatively small and compact, and has a low cost of design, fabrication, shipping, maintenance and repair.

SUMMARY OF THE INVENTION

The present invention includes a recognition of some of the problems encountered in previous devices. It is believed that some problems in previous devices are attributable to variations in coin velocity in the region of the coin sensors or acceptors, e.g., such as may result from the coins striking other coins, guides, walls or other obstructions or being misshapen or dirty. Other difficulties can arise when sequential coins passing a coin sensor or acceptor overlap or are too closely spaced, such that properties sensed in one coin influence or are not properly distinguished from the properties of a subsequent coin.

In one embodiment, the coins are moved past a sensor or acceptor by a constant-velocity belt, preferably while opposed faces of the coins are each engaged with a separate belt. In one embodiment, the belts are narrower than the diameter of the largest coin which is handled by the device, and coins are deflected by devices which can extend past either side of the belt such that the entire mechanism can be fit in a space having a width about equal to, or only slightly larger than, the diameter of the largest coin being handled.

In one embodiment, coins are separated from one another prior to movement past the coin sensors by a mechanism which includes a controllable plunger, such as a solenoid device, for holding the coin stationary until a preceding coin has moved away by at least a predetermined amount. In another embodiment, sequential coins are engaged by sets of rollers with the rollers which en-age the leading coin being capable of a higher rotational velocity to accelerate such coin away from the following coin. In still another embodiment, coins are engaged by a lead screw device wherein the pitch of the screw threads defines spacing of sequential coins.

BRIEF DESCRIPTION OF THE DRAWINGS

FIG. 1 is a front elevational view of the coin spacing and transport device according to an embodiment of the present invention;

FIG. 2 is a side elevational view of the apparatus in FIG. 1;

FIGS. 3A, 3B, 3C, 3D are front elevational views of a coin separation device as two coins are sequentially input according to an embodiment of the present invention;

FIG. 4 is a side elevational view of a single solenoid compressive coin separator;

FIG. 5 is a side elevational view, partly in cross-section, of a two-solenoid coin separating device;

FIG. 6 is a front elevational view, partly in cross-section, of a coin separating device according to an embodiment of the present invention;

FIG. 7 is a partial top plan view of the apparatus of FIG. 6; and

FIGS. 8A through 8D are side elevational views of a roller-based coin separating device as two sequential coins are handled.

DETAILED DESCRIPTION OF THE PREFERRED EMBODIMENTS

As depicted in FIGS. 1 and 2, according to one embodiment of the invention, sequential coins are handled by an apparatus having a coin spacing portion 112 and a transport portion 114. The spacing portion 112, in the depicted embodiment, includes a solenoid 116 for controlling a plunger 118 and a detector such as a photocell 124. As depicted in FIGS. 3A through 3D, before the first coin 120*a* is inserted into the coin slot 122, the solenoid 116 is configured to extend the plunger 118 so as to block the coin 120 from moving past the plunger 118. As the coin moves downward, it comes into alignment with a detector such as a photocell 124. Other types of detectors can also be used, such as mechanical switches, provided the detector has a sufficiently rapid response rate. Once the coin has reached the photocell, as depicted in FIG. 3B, a controller, which may be a timer or a microprocessor 126, determines whether the plunger 118 has been extended for a time sufficiently long to allow any preceding coin to move downward, preferably by at least a first separation distance 128. The timing may be implemented in software, firmware or in a discrete circuit such as an application-specific integrated circuit (ASIC). Until this time has expired, the plunger 118 remains extended. After a minimum separation time has expired, the plunger 118 is withdrawn allowing the first coin 120*a* to drop. When the first coin 120*a* has dropped a sufficient distance to clear the plunger 118, the controller 126 causes the solenoid 116 to extend the plunger 118 such that a following coin 120*b*, even if closely following, or touching, downward movement of the following coin 120*b* is blocked by the extended plunger 118 as depicted in FIG. 3D, while the preceding coin 120*a* continues to move, thus eliminating on avoiding overlap between adjacent coins, preferably creating a minimum separation distance 128 between the first coin 120*a* and the second coin 120*b*. When the next coin 120*b* is detected by the detector 124, the process repeats.

FIG. 4 depicts another embodiment in which the plunger 118, rather than extending across the depth of the slot 122 and engaging an edge of the coin, as depicted in FIG. 3D, instead is positioned opposite a surface, preferably a resilient surface such as a rubber pad 132, in order to engage a coin 120*b* by pinching or compressing between the plunger 118 and the pad 132. As in the embodiment of FIGS. 3A through 3D, the plunger 118 retains the coin 120*b* in a stationary position for a period long enough to eliminate overlap and preferably to permit the preceding coin 120*a* to move at least a predetermined minimum spacing 128 away from the following coin 120*b*. After being released from confinement, the coin moves adjacent sensors 134 which, in the depicted embodiment, are optic sensors such as qualifying optics 136*a* and count and/or direction optics 136*b*. The qualifying optics 136*a* are used to determine whether the adjacent object is an acceptable coin (as opposed to, e.g., a slug, a foreign coin, an improper denomination, etc.) and the count and direction optics 136*b* are provided for sensing coins for the purpose of counting the number of acceptable coins, calculating the value of coins which have been input, controlling mechanisms which direct particular coins to various destinations (as described more thoroughly below) and the like. Although optical sensors have been depicted in FIG. 4, other types of sensors can be used, including magnetic or electromagnetic sensors, ultrasonic sensors, mass or inertial sensors and the like.

In the embodiment of FIG. 5, first and second solenoids 116, 117 and plungers 118, 119 are configured and positioned in a manner similar to that depicted in FIGS. 3A through 3D for providing non-overlap and/or proper separation 128 between coins. Preferably, the two solenoids work alternately to stop the following coin until separation is achieved.

Preferably, the apparatus works relatively rapidly as the preceding coin 120*a* moves rapidly away from the following coin 120*b* (either accelerated by gravity or being positively driven, e.g., as described more thoroughly below), and the amount of time that the following coin 120*b* is retained stationary is relatively short and, in particular, sufficiently short that it is substantially imperceptible to a user, even a user who is inserting coins into the slot at a high rate. Preferably, the solenoids are fast acting solenoids capable of operation or cycling in a period of about 2 to about 4 milliseconds. Thus, one advantage of the invention is the ability to permit a user to insert coins rapidly into a coin slot while avoiding inaccuracies or jams that can occur when coins are closely spaced. This results in a device which is able to validate and sort coins at a very rapid rate while providing reduced errors, high coin throughput and enhanced user satisfaction.

Another advantage of the depicted coin separators is that the devices occupy very little space and, in particular, very little space in the dimension of the coin diameter. This provides the ability to design new devices with a smaller footprint and/or a lighter weight than otherwise possible. The configuration eliminates or reduces potential for misuse or cheating, such as by rapidly introducing a slug or other improper object immediately after a valid coin ("freight training") or attaching a wire or string to a coin and attempting to retrieve the coin after it has been counted ("stringing").

FIGS. 6 and 7 depict another mechanism which can be used to achieve coin separation. In the configuration in FIG. 6, a lead screw 142 is positioned adjacent the pathway to be traversed by the coins 120*a* through 120*d* and rotated 144 by a motor 146. The coins 120 are urged laterally between turns of the screw thread by an edge guide 148. Preferably, the edge guide 148 is mounted to permit lateral movement 152, e.g., by a pin and slot arrangement 154*a*, 154*b*, and urged towards the lead screw 142, e.g., by a spring 156. The pitch of the screw determines the separation, for a given diameter of coin, and the rate of rotation of the lead screw around its longitudinal axis 166 determines the velocity of coin movement. The pitch of the lead screw 158 is selected so that when sequential coins 120*a*, 120*b*, 120*c* are urged between successive turns of the lead screw threads, as depicted, the coins will be forced to have a minimum separation 128. In particular, the pitch 158 should be such that, for the largest diameter coin to be handled by the device, the distance 162 between points of tangency of adjacent coins with adjacent turns of the thread is large enough that adjacent coins 120*c*, 120*b* will have the minimum separation 128. Preferably, the guide 148 includes a channel 149, e.g., to maintain the planar relation of the coins. The configuration of FIGS. 6 and 7 can be used with two or more lead screws, e.g., with a central guide, or a single lead screw may be used for separating two or more streams of coins at other radial positions (e.g., 164*a*, 164*b*, 164*c*). Although FIG. 6 depicts the lead screw 142 being subject to direct drive by motor 146, one or more lead screws may be driven by a single motor or by multiple motors and/or may be linked by gears or belts. Double screws may be contra-rotating to reduce twisting effects on the coins. Rather than being separated by a device which rotates along an axis 166 parallel to the axis of coin movement 168, separation may be achieved by a device (such as a cogged or toothed belt) which moves linearly, at least for a portion of its travel, parallel to coin movement 168.

The embodiments of FIGS. 6 and 7 provide not only the advantage of achieving coin separation, but also placing the coins under positive drive so that the downward velocity of the coins can be controlled by controlling screw rotation rate, e.g., to be constant if desired. Controlled, constant movement of the coins, even after separation has been achieved, is desirable for a number of reasons. First, it avoids impact or overlapping of coins which can result from non-constant velocity following the separation (such as may occur from impact or sticking of coins against guideway or other surfaces or other coins). Constant velocity is also useful for purposes of conveying coins past a sensor or acceptor mechanism. Thus, in the embodiment of FIG. 6 it is possible to position sensors such as characterization or acceptor sensor 172*a* and/or count and/or direction sensor 172*b* along the pathway of the coins in the region where coin velocity is controlled by the lead screw 142. Thus, in the embodiment of FIG. 6, a single mechanism achieves both separation and constant velocity control of the coins. It is believed that by moving coins past sensors 172*a*, 172*b* at a substantially constant velocity, a reduced error rate can be achieved. If desired, it is also possible to use a lead screw mechanism only for the purpose of providing coin separation and to position sensors 172*a*, 172*b* at locations which are not in the region 174 controlled by the lead screw 142.

FIGS. 8A through 8D depict another apparatus for achieving coin separation. In the embodiment depicted in FIG. 8A, opposite faces of the coin 120*a* are sequentially engaged by two pairs of opposed counter-rotating rollers 182*a*, 182*b*, 184*a*, 184*b*. In one embodiment, rollers 182*a* and 184*a* are driven, while rollers 182*b* and 184*b* are free-running (idler rollers), preferably spring-loaded in directions 186*a*, 186*b* towards the driven rollers 182*a* and 184*a*, respectively. The lower driven roller 184*a* is driven at a rotational rate greater than that of the upper driven roller 182*a*. In one embodiment, roller 184*a* is driven at an RPM about three times that of roller 182*a*. As depicted in FIG. 8B, as a coin 120*a* engages the first set of rollers 182*a*, 182*b*, it is driven downward 188 at a velocity determined by the circumferential velocity of the upper driven roller 182*a*. The coin will continue to be driven by the roller pair 182*a*, 182*b*, and will eventually reach the second pair of rollers 184*a*, 184*b* and become engaged therewith as depicted in FIG. 8C. In the embodiment depicted in FIG. 8A, the rollers have a longitudinal spacing 192 smaller than the diameter of the coins 120 so that, in the position depicted in FIG. 8A, the first coin 120*a* is simultaneously engaged by both the bottom driven roller 184*a* and the upper driven roller 182*a*. Roller 182*a* is configured to permit overrunning, i.e., to permit it to be rotated at a rate faster than the rotational rate at which it is being driven, e.g., by using a one-way clutch. Thus, since roller 184*a* is driven at a rotational rate faster than roller 182*a*, when the first coin 120*a* is engaged by both rollers 182*a* and 184*a*, it will be moved at the higher rate determined by the rotational rate of the lower roller 184*a*, causing overrunning of the upper roller 182*a*. Thus, while the coin 120*a* is engaged only by the upper set of rollers 182*a*, 182*b* as depicted in FIG. 8B, its downward velocity 188 will be a lower velocity determined by the lower rotation rate of the upper driven roller 182*a*. However, when it has moved to a position in which it is engaged by the lower roller 184*a*, its downward velocity 188 will increase to a rate determined by the rotation rate of the lower roller 184*a*. As depicted in FIG. 8C, if there is an immediately-following coin 120*b*, this coin will also be moving, for a short period of time, at the higher rate determined by the lower roller 184*a*, since the mutual engagement of the coin 120*a* with both driven rollers 182*a* and 184*a* causes the upper roller 182*a* to overrun and move at the higher rate.

Eventually, the preceding coin 120*a* will move downward past the point at which it is engaged with the upper roller 182*a*, although it will still be engaged by the lower roller 184*a*. At this point, the lower coin 120*a* will continue to be driven downward 188 at the higher rate. However, because there is no longer a coupling of the lower roller 184*a* with the upper roller 182*a* by a commonly engaged coin, the rotation rate of the upper roller 182*a*, which is engaging the following coin 120*b*, will return to its (slower) driven rate. Thus, the lower coin 120*a* will be moving downward at a higher rate than the upper coin 120*b*, causing the coins to separate 128 as desired.

As an alternative, rather than providing the upper, slower roller with the ability to overrun its driven rotation rate, the sets of rollers can be moved farther apart so that there is never a time in which both rollers are engaged with a single coin. The embodiment of FIGS. 8A through 8D, in addition to providing the advantage of achieving the desired separation, also provide positive driving of the coins at a known velocity, as opposed to relying on the falling of or sliding of coins under gravitational force. The rollers may either be constantly rotating or coin-activated. In order to achieve the pinch-roller effect, rather than being spring loaded together, the proposed rollers can be on fixed centers but made of elastomeric construction or coating. The motor-to-roller drive train can be via friction, gears or belts, or a combination thereof. If desired, other train devices, such as belts, can be used, rather than rollers.

Returning to the embodiment depicted in FIGS. 1 and 2, after achieving separation, either as depicted in FIGS. 1 and 2 or as described above in connection with FIGS. 3 through 8, coins are conveyed past the coin sensor or acceptor device 134. The acceptor sensors or optics can include optics intended for validating, counting and/or redirecting the coins. The sensors provide data regarding coin characteristics (such as diameter, conductivity, magnetic permeability, eddy current flow, thickness, or mass) to a microprocessor or other controller which may, if desired, be the same controller 126 used in connection with the separation device. The controller 126 controls direction devices such as solenoids 116*a*, 117*a* for pushing or otherwise selectively diverting coins to various locations such as a coin drop chute 204 or a hopper chute 206 or permitting the coin to proceed without diversion, e.g., to a reject chute or bin 208. In one embodiment, coins which are not diverted travel from the input slot 122 or head to the undiverted destination 208 in a substantially vertical and straight line. Preferably, all coin paths are configured to lie substantially in line with the coin slot 122.

As noted above, coin characterization can be assisted by moving the coins past the sensor area 134 at a constant or known velocity and/or by knowing or controlling the position of each coin being examined. In the embodiment of FIGS. 1 and 2, constant or known velocity is achieved by providing for positive drive of the coins in the region of the sensors 134. In the depicted embodiment, positive drive is provided by one or more powered endless belts 210*a, b, c*, driven by one or more motors 212. In one embodiment, in order to readily achieve coordination of belt speed along the various belts, a single motor 212 is coupled, via roller 214, to a first belt 210*a* and rollers 214*b*, 214*c* are powered by the same motor 212 via gears, belts, friction drives, or a combination of these. Alternatively, separate motors can be provided for each belt with motor controllers used to achieve desired (preferably equal) belt velocities, e.g., using a servo mechanism. Belts 210*b* and 210*c* may be free-running or idler belts rather than driven belts. In one embodiment, the belts 210*a*, 210*b*, 210*c* are driven at a speed substantially equal to or greater than the speed at which the coins enter the drive mechanism (typically, the coin velocity at the exit point of the separating device 112), e.g., a linear rate of between about 20 mm per second and about 30 mm per second. Rather than being mounted as depicted in FIG. 1, the motor 212 may be mounted closer to the belts 210 (e.g., to provide for a smaller overall width 216 of the apparatus) or may be remote-mounted. The belts 210*a*, 210*b*, 210*c* may be elastomeric, rigid, toothed, plain, or a combination of these. In the depicted embodiment, coins are pinched between paired belts, e.g., between belt 210*a* and 210*b* in the upper portion and between 210*a* and 210*c* in the lower portion, although single belts (e.g., provided on an incline or provided with a guide device) may be used.

In the depicted embodiment, three belts are provided in order to permit diversion of the coins into three paths 204, 206, 208. Thus, downstream of the sensor region 134, the second belt 214*b* recurves or terminates to define a first area 222 in which coins are adjacent only the first belt 210*a*. In the depicted embodiment, diversion of a coin under control of the controller 126 in region 222 is achieved by extending a forked-tipped plunger 118*a* having tines 224*a*, 224*b* extending on either side of the first belt 210*a*. Thus, in the depicted embodiment, at least one belt 210*a* is substantially narrower than the distance between the tines 224*a*, 224*b*, and the times 224*a*, 224*b* are spaced apart a distance which is less than the diameter of the smallest coin expected to be handled by the device. In the depicted embodiment, characterization and/or count and direction operations are performed while the coin is trapped between two belts. Similarly, in a second region, the first belt 210*a* recurves or terminates before the recurvature of the second belt 210*c* to provide a region for diversion of coins to, e.g., the hopper chute 206, using solenoid 117*a* and forked plunger 119*a*. If desired, both plungers 118*a* and 119*a* could be configured to divert toward the same side of the belts by extending belt 210*a* past the recurvature or termination ofbelt 210*c*. If desired, fewer diversion regions or devices could be provided (or none, if only characterization and not diversion is required), or more diversion areas could be provided by adding and/or extending belts in an analogous manner.

As depicted, the width 216 required for implementation of this device, depending, e.g. on the placement of the motor 212, can be substantially equal to or slightly larger than the width 228 of the largest-diameter coin to be handled by the device. In one embodiment, the width 216 is no more than about 60 mm, and preferably less than 10 mm wider than the width 228 of the largest coin. By providing a relatively narrow acceptor/separator, the gaming device, vending machine or other apparatus can be either provided with a narrower overall shape or footprint, or additional devices, such as a bill acceptor, credit card or smart card acceptor and the like can be positioned in the area now unoccupied by the smaller acceptor. The depicted devices can also be accommodated in a space which has less height and/or depth than previous devices. The savings in height and depth can be advantageous for a number of reasons. For example, a shorter acceptor may provide room for a larger hopper or drop box. A device with less depth may mean that, when the acceptor is mounted to a door of a device (as is common), the door may be made thinner or out of other materials, potentially saving overall costs. Savings in height or depth can also be used to reduce the overall size of the gaming device, vending device, or other device as a whole. Furthermore, by providing coins with a known velocity or position and/or constant velocity as the coins move past the sensors 134, increased accuracy and/or decreased cost of sensors or controllers 126 are provided. Misuse or cheating opportunities are reduced or eliminated. Preferably, all three coin destinations, drop 204, hopper 206 and reject bin 208, are provided within about the width of one coin 228.

Although the depicted embodiments show handling of a single denomination of coin, each having a predefined diameter and thickness, the apparatus can be configured either to be optimized for use with only a single sized coin or can be configured to accommodate a range of diameters and/or thicknesses of coins.

In light of the above description of the invention, a number of advantages can be seen. The apparatus provides for increased accuracy and/or reduced cost of a coin acceptor/counter while providing for small and/or reduced space requirements, particularly a width generally commensurate with a coin diameter. Enhanced throughput of good coins can be achieved and coin spacing is provided without perceptible slowdown of acceptance, leading to improved customer satisfaction.

A number of variations and modifications of the invention can be used. It is possible to use some aspects of the invention without using other aspects. For example, it is possible to use one or more of the disclosed separation devices without using the disclosed transport devices. Although solenoids and plungers have been disclosed for diverting coins, other devices such as peel knives and/or rakes can be used alone or in combination. Control can be achieved by way of a microprocessor or similar logic device (controlled by software and/or firmware) or using hard-wired logic.

Although the invention has been described by way of preferred embodiments and certain variations and modifications, other variations and modifications can also be used, the invention being defined by the following claims:

What is claimed is:

1. A method for use in a coin acceptance device which includes acceptance components positioned along a coin stream path for an acceptance process of validating or counting coins received in a first receiving area, the method comprising:

receiving first and second coins;

substantially immobilizing said second coin at a first location by activating an engagement device;

detecting when said first coin is moving from said first location away from said second coin;

controlling said engagement device to release said second coin from said first location after said step of engaging and without engaging a third coin at a second location upstream of said first location thereby separating consecutive coins wherein overlap is substantially avoided; and conveying said consecutive coins to at least a first of said acceptance components such that said consecutive coins are non-overlapping with respect to each other upon reaching said first of said acceptance components.

2. A method as claimed in claim 1 wherein said step of separating comprises separating consecutive coins by at least a minimum separation distance.

3. A method as claimed in claim 1 wherein said consecutive coins continue to be non-overlapping throughout said acceptance process.

4. A method as claimed in claim 1 further comprising:

conveying said coins past said acceptance component at a substantially predetermined velocity.

5. A method as claimed in claim 1 wherein said coins are conveyed past said acceptance component in the absence of gravity feed.

6. A method as claimed in claim 4 wherein said step of conveying comprises conveying coins using at least a first belt.

7. A method as claimed in claim 6 wherein said first belt has a width less than the diameter of the largest of said coins.

8. A method as claimed in claim 6 further comprising at least a first solenoid for extending a plunger past at least a first side of said first belt to divert a coin.

9. A method as claimed in claim 4 wherein said step of conveying includes conveying the coin while positioned between first and second belts.

10. A method as claimed in claim 9 wherein at least portions of said first and second belts are offset from one another to define a first region having a belt on only one side of said coin.

11. A method as claimed in claim 10 further comprising diverting the coin in at least said first region.

12. A method as claimed in claim 9 further comprising sensing properties of said coins while said coins are positioned between said first and second belts.

13. A method for use in a coin acceptance device which includes acceptance components for an acceptance process of validating or counting coins received in a first receiving area, the method comprising:

separating consecutive coins wherein overlap is substantially avoided;

conveying said consecutive coins to at least a first of said acceptance components such that said consecutive coins are non-overlapping with respect to each other upon reaching said first of said acceptance components;

conveying said coins past said acceptance component at a substantially predetermined velocity;

wherein said step of conveying comprises conveying coins using at least a first belt;

extending a plunger past at least a first side of said first belt to divert a coin; and wherein said plunger has a forked end with tines extendible past each edge of said belt.

14. A method as claimed in claim 30, further comprising:

positioning said first coin between first and second belts, said first belt extending between first infeed and outfeed rollers to define a first belt transport extent, said second belt extending between second infeed and outfeed rollers to define a second belt transport extent, substantially all of said second belt transport extent being adjacent to at least a portion of said first belt transport extent;

conveying said coins toward an acceptance component using said first and second belts.

15. A method as claimed in claim 14 wherein at least one of said belts has a width less than about the width of the largest of said coins.

16. A method as claimed in claim 14 wherein said acceptance components are positioned such that said coins are between said first and second belts when said coins are adjacent said acceptance components.

17. Apparatus for use in a coin acceptance device which includes acceptance components located along a coin stream path for characterizing or counting coins received in a first receiving area, the apparatus comprising:

means for receiving first and second coins;

means for substantially immobilizing said second coin at a first location by activating an engagement device;

means for detecting when said first coin is moving from said first location away from said second coin;

means for controlling said engagement device to release said second coin from said first location after said step of engaging without engaging a third coin at a second location upstream of said first location thereby separating consecutive coins by at least a minimum separation distance; and means for conveying said consecutive coins to at least a first of said acceptance components while preventing impact, friction or adhesion of coins from reducing said separation to a value less than said minimum separation distance before reaching said first of said acceptance components.

18. Apparatus as claimed in claim 17 wherein said means for conveying includes means for moving said coins past said acceptance components at a substantially predetermined velocity, in the absence of gravity feed.

19. Apparatus for use in a coin acceptance device comprising:

coin separation means for separating consecutive coins by at least a minimum separation distance;

acceptance means for characterizing or counting coins received in a first receiving area;

first and second counter-rotating endless belts defining a region therebetween for receiving said coins and conveying said coins past said acceptance means wherein said first endless belt defines a first loop having a first loop length and said second endless belt defines a second loop having a second loop length less than said first loop length;

a third endless belt adjacent a portion of said first endless belt and spaced from said second endless belt to define a first diversion region therebetween;

a first solenoid coupled to a first plunger adjacent said first diversion region, said first plunger having a forked end for extending past first and second edges of said first belt to contact a first coin positioned in said first diversion area in response to sensed characteristics of said first coin sensed by said acceptance component;

said third endless belt defining a third loop having a third loop extent and extending beyond said first loop extent to define a second diversion region;

a second solenoid coupled to a second plunger adjacent said second diversion region, said second plunger having a forked end for extending past first and second edges of said third belt to contact a second coin positioned in said first diversion region in response to sensed characteristics of said second coin sensed by said acceptance component; and wherein said first, second and third endless belts have a width substantially less than the diameter of said coins and wherein said first, second and third belts define a substantially straight-line coin path.

20. A method for separating first and second coins comprising:

conveying said first coin by a first conveyance device in a first direction, said conveyance device having a width less than the diameter of the largest coin to be processed;

engaging said first coin with a second conveyance device operating at a first velocity to convey said first coin in said first direction while said second coin is engaged with said first conveyance device driven at a second velocity which is less than said first velocity to convey said second coin in said first direction wherein said first coin is engaged by both said first and second conveyance devices during a first time period and wherein said first and second conveyance devices operate at substantially said first velocity during said first time period.

21. A method as claimed in claim 20 wherein said first and second conveyance devices are selected from the group consisting of rollers and conveyor belts.

22. A method as claimed in claim 20 wherein at least one of said first and second conveyance devices comprises a pair of rollers.

23. A method as claimed in claim 22 wherein the first of said rollers is driven and the second of said rollers is an idler roller.

24. A method as claimed in claim 20 further comprising conveying said first coin past a coin acceptance device using said second conveyance device.

25. A method as claimed in claim 20 wherein said first conveyance device is configured to overrun during at least said first time period.

26. Apparatus for separating first and second coins comprising:

first means for conveying said first coin in a first direction, said first means having a width less than the diameter of the largest coin to be handled; and second means for engaging said first coin and operating at a first velocity to convey said first coin in said first direction while said second coin is engaged with said first conveyance device driven at a second velocity less than said first velocity to convey said second coin in said first direction wherein said first coin is engaged by both said first and second conveyance devices during a first time period and wherein said first and second conveyance devices operate at substantially said first velocity during said first time period.

27. Apparatus for separating first and second coins along a coin stream path comprising:

a first pair of counter-rotating pinch rollers driven at a first velocity rotating in directions so as to convey coins therebetween in a first direction; and a second pair of pinch rollers rotating in directions so as to convey coins therebetween in said first direction and positioned to receive and engage a first coin that has been previously engaged by said first pair of rollers, said second pair of rollers operating at a second velocity greater than said first velocity wherein said first coin is engaged by both said first and second pinch rollers during a first time period and wherein said first and second pinch rollers operate at substantially said first velocity during said first time period.

28. A method for separating first and second coins comprising:

engaging said first coin with a first engagement device at a first location, engaging said second coin with said first coin engagement device at said first location in the absence of relative motion between said second coin and said first coin engagement device while said first coin is moving from said first location away from said second coin; and releasing said second coin from said first location without engaging a third coin at a second location upstream of said first location.

29. A method as claimed in claim 28 wherein engaging said second coin comprises substantially immobilizing said second coin.

30. A method as claimed in claim 28 wherein said first coin engagement device comprises a solenoid.

31. A method as claimed in claim 28 further comprising:

detecting when said first coin is moving in said first direction away from said second coin;

controlling said coin engagement device to permit movement of said second coin a predetermined period after said step of detecting.

32. A method as claimed in claim 31 wherein said step of detecting is performed using a photocell.

33. A method as claimed in claim 31 wherein said step of detecting is performed in response to said step of controlling said engagement device.

34. Apparatus for separating first and second coins along a coin stream path comprising:

means for engaging said second coin with a first coin engagement device while said first coin is moving away from said second coin in a first location;

means for detecting when said first coin is moving in said first direction away from said second coin;

means for controlling said coin engagement device to release said second coin to permit movement of said second coin from said first location, a predetermined period after said detecting by said means for detecting without engaging a third coin at a second location upstream of said first location.

35. Apparatus as claimed in claim 34 further comprising:

a first driven endless belt having a first substantially planar region adjacent an acceptance components, positioned to receive said first coin; and a second endless belt having a second planar region the substantial entirety of which is adjacent and opposed to at least a portion of said first region and defining a coin conveyance area therebetween.

36. Apparatus for separating first and second coins along a coin stream path, comprising:

a detection device which outputs a first signal when a first coin moves from a first location away from said second coin, past a first point along said coin stream path;

a solenoid which is controlled, in response to said first signal, to engage a second coin at said first location, preventing movement thereof, until at least a first predetermined period has elapsed after said first signal, whereupon said solenoid is controlled to release said second coin from said first location without engaging a third coin at a second, upstream location.

* * * * *